US006443430B1

(12) United States Patent
Eisterlehner

(10) Patent No.: US 6,443,430 B1
(45) Date of Patent: Sep. 3, 2002

(54) SPREADING DEVICE

(75) Inventor: Leopold Eisterlehner, Steinbach a.d. Steyr (AT)

(73) Assignee: Weber-Hydraulik GmbH, Losenstein (AT)

( * ) Notice: Subject to any disclaimer, the term of this patent is extended or adjusted under 35 U.S.C. 154(b) by 0 days.

(21) Appl. No.: 09/958,247

(22) PCT Filed: Apr. 4, 2000

(86) PCT No.: PCT/AT00/00077

§ 371 (c)(1),
(2), (4) Date: Oct. 5, 2001

(87) PCT Pub. No.: WO00/59578

PCT Pub. Date: Oct. 12, 2000

(30) Foreign Application Priority Data

Apr. 6, 1999 (AU) ..... 224/99 U

(51) Int. Cl.[7] ..... B66F 3/24

(52) U.S. Cl. ..... 254/93 R; 72/705; 254/124; 254/133 R

(58) Field of Search ..... 254/93 R, 93 H, 254/18, 164, 124, 93 HP; 72/392, 705; 29/252, 239; 81/301, 302, 349, 383.5

(56) References Cited

U.S. PATENT DOCUMENTS 3,635,440 A * 1/1972 Van Gompel ..... 254/93 R
4,273,311 A * 6/1981 Rio ..... 354/93 R
4,392,263 A * 7/1983 Amoroso ..... 7/100
4,531,289 A 7/1985 Brick
4,789,134 A 12/1988 Tenuto, Jr. et al.
4,973,028 A 11/1990 Linster
5,622,353 A 4/1997 Painter et al.
5,810,333 A * 9/1998 Hickerson et al. ..... 254/93 R

FOREIGN PATENT DOCUMENTS

EP 0 271 207 6/1988

OTHER PUBLICATIONS

Database WPI, Section PQ, Week 199402, Derwent Publ., XP002144899, NL 9 200 881, Dec. 16, 1993.

* cited by examiner

*Primary Examiner*—Joseph J. Hail, III
*Assistant Examiner*—Daniel Shanley
(74) *Attorney, Agent, or Firm*—Collard & Roe, P.C.

(57) ABSTRACT

The invention describes a spreading tool (1) for widening openings, in particular for use in extricating trapped persons, having a drive (3) to which a pressurised medium (4) is applied and, coupled therewith in order to effect a synchronous counter-pivoting motion in the form of cutting and/or spreading elements, pivotably mounted pivot arms (16, 17) in a housing (15) accommodating the drive (3). The pivot arms (16, 17) are drivingly linked to a pressure ram assembly (48) which is displaceable in the direction of a parallel extending longitudinal central axis (53) substantially parallel with a pivot plane (20) of the pivot arms (16, 17).

16 Claims, 4 Drawing Sheets

SPREADING DEVICE

CROSS REFERENCE TO RELATED APPLICATIONS

Applicant claims priority under 35 U.S.C. §119 of Austrian Application No. GM 224/99 filed Apr. 6, 1999. Applicant also claims priority under 35 U.S.C. §120 of PCT/AT00/00077 filed Apr. 4, 2000. The international application under PCT article 21(2) was not published in English.

The invention relates to a spreading device of the type outlined in the generic part of claim 1.

A spreading tool is known from U.S. Pat. No. 5,810,333 A, consisting of a telescopic arrangement of two tubes, an outer tube having an end face with a ram member inside which the inner tube, also having a ram member, is slidably mounted. The outer tube has an opening in the wall for inserting spreadable tips of a spreading drive. In order to perform a spreading operation, the spreading tool is positioned between the parts to be spread and the telescopic arrangement operated with an independent spreading drive. The resultant spreading path is dependent on the opening width of the lever arms of the spreading drive and is therefore relatively small. In order to produce larger spreading widths, a spreading ram which can be adjusted in stages in an axial direction relative to the inner tube has to be fitted and the spreading drive operated again after each adjustment, requiring a considerable amount of time to achieve adequate spreading widths.

Accordingly, the objective of the invention is to propose a device which, being of the standard size and weight for this type of rescue equipment, has an expandable range which is such that the attainable opening widths correspond to the regulations governing "man openings", stipulated in the regulations governing pressurised containers, for example.

This objective is achieved by the invention due to the characterising features of claim 1. The surprising advantage of this arrangement is that by providing a pressure ram assembly operable by means of pivot arms, the spreading range of the extrication tool is doubled without the need to use more powerful drives and incurring only a slight increase in the weight of the device.

An embodiment of the type defined in claim 2, which has pressure rams adjustable by a guiding system, is of advantage because the expansion forces to be applied to the peripheral regions of the wall and structural areas, which are generally irregular relative to one another, can be exactly aligned regardless of the force components occurring as a result of the reaction forces which act on the predetermined longitudinal central axis determined by the longitudinal central axis of the pressure ram assembly.

Claim 3 describes another embodiment which has the advantage of producing high resistance torques in the guiding system which counteract any buckling of the pressure ram assembly.

The advantageous embodiments described in claims 4 and 5 offer a technically simple and inexpensive way of obtaining an axially stable arrangement.

Claim 6 describes an advantageous embodiment whereby movement is exactly dependent on the telescopic assembly of sections.

A preferred embodiment is also described in claim 7, whereby standard extrication apparatus can be optionally retrofitted with a pressure ram assembly in order to increase the expandable range.

Claim 8 describes an other advantageous embodiment which enable a high force to be applied and a durable, uninterrupted coupling to be obtained.

A preferred embodiment is described in claim 9, whereby any torsional forces which might occur, as is the case when spreading irregularly shaped wall elements, materials, etc., are absorbed.

Standard tubes are used for the advantageous embodiment described in claim 10, making this design inexpensive.

As a result of an advantageous embodiment of the type described in claim 11, the individual sections can be prevented from twisting without the need for additional anti-twisting means.

Other possible embodiments are described in claims 12 to 14, by means of which the pressure ram assembly can be fixed in the expanded position at the end of a spreading operation, thereby not active or when the spreading tool is removed.

The embodiment described in claim 15 ensures that the regions impeding extrication of a person are sufficiently spaced apart to comply with the measurements specified in safety standards and regulations.

Finally, an embodiment of the type described in claim 16 is of advantage because it provides a non-slip support for the spreading tool on sheet metal and plastics, which generally have very smooth surfaces.

To provide a clearer understanding, the invention will be described in more detail below with reference to examples of embodiments illustrated in the appended drawings.

Of these:

Figure 1:
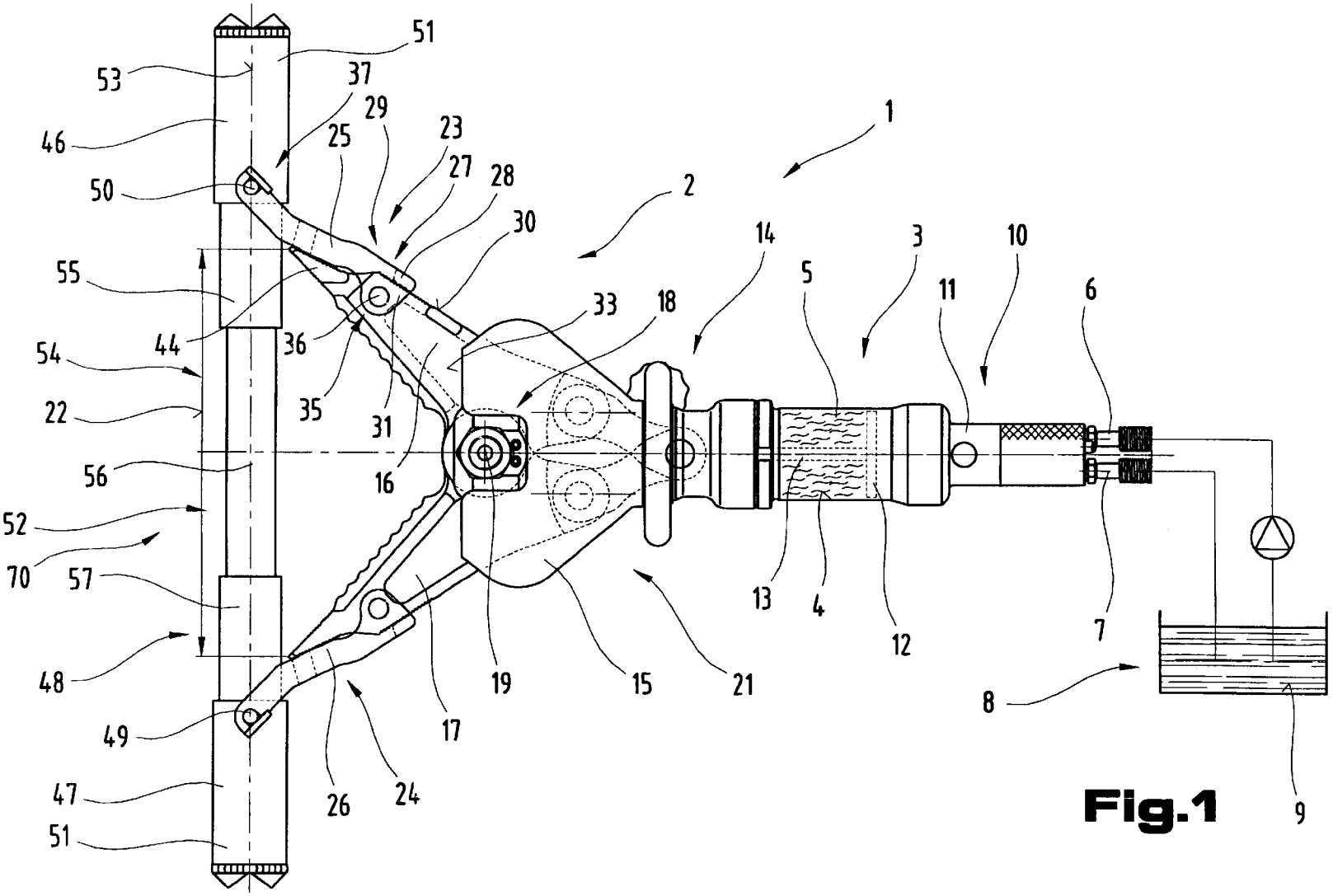
FIG. 1 is a front view of a spreading tool as proposed by the invention with a rescue system.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

Figure 2:
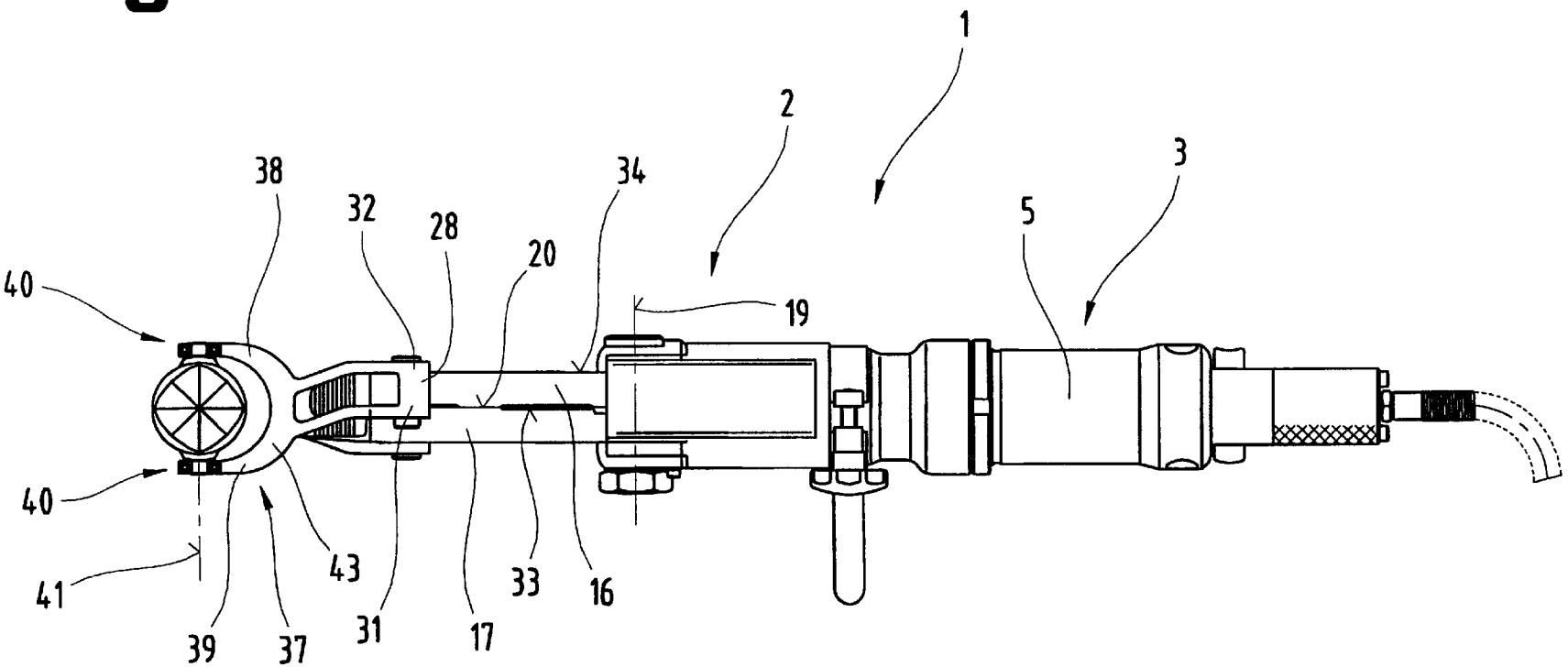
FIG. 2 shows the spreading tool illustrated in FIG. 1, in a view rotated by 90°.
Figure 3:
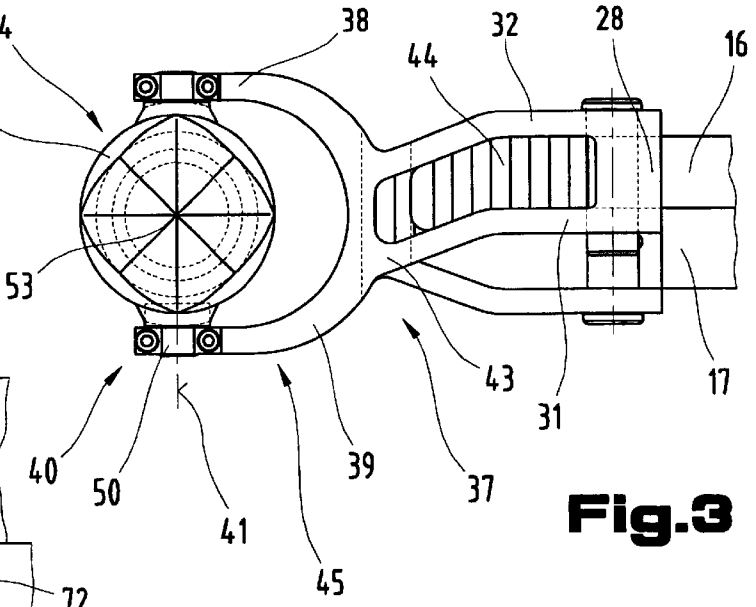
FIG. 3 is a detailed view of the spreading tool proposed by the invention.

FIGS. 1 to 3 illustrate a spreading tool 1 for a standard multi-function rescue tool system 2.

The rescue tool system 2 consists of a liner drive 3, e.g. a cylinder 5 to which a pressurised medium 4 is applied, supplied with hydraulic oil 9, for example, from a compressor unit 8 via a delivery line 6 and return line 7. A control unit 10, e.g. a push button-operated multi-way valve 11, is provided on the input side of the cylinder 5 so that a piston 12 of the cylinder 5 can be operated in a reciprocating motion and the delivery line 6 and return line 7 shut off. On an end face region 14 enclosing a piston rod 13, the cylinder 5 has a housing 15, inside which a common mounting assembly 18 is provided for a pair of pivoting arms 16, 17, which are mounted therein and are pivotable in a scissor motion in a pivot plane 20 perpendicular to a pivot axis 19 of the mounting assembly 18. The driving action is provided by the piston rod 13 of the cylinder 5, which is drivingly linked to the pivot arms 16, 17 via a lever system 21. The pivot arms 16, 17, which are of a finger-type design, are used for a cutting procedure when operated in a closing motion and have jaws for a spreading function when operated in an opening motion, complying with an established standard whereby a maximum expandable width 22 of between 300 mm and 350 mm, preferably 330 mm, is obtained.

Projecting beyond cantilevered end regions 23, 24 on the pivot arms 16, 17 are finger-type driving elements 25, 26. Other aspects of the driving elements 25, 26, their design and how they are linked to the pivot arms 16, 17, will be explained below with reference to pivot arm 16 in conjunction with driving element 25 and the essence of this description can be transposed to the other pivot arm 17 and driving element 26.

In a linking region 27, the driving element 25 encloses the pivot arm 16 in a U-shaped arrangement, whereby a base bridge 28 forms an abutment 29 lying against a rear face 30 and legs 31, 32 overlap the pivot arm 16 in certain regions of side faces 33, 34. The legs 31, 32 and the pivot arm 16 are provided with bores 35 running perpendicular to the side faces 33, 34, in which a removable pin 36 is inserted to link the driving clement 25 to the pivot arm 16, thereby affording a releasable connection. An end region 37 of the driving element 25 projecting beyond the pivot arm 16 is provided with fork-type operating jaws 38, 39 having radial bearings 40, which are provided in particular in the form of split pivot axes 41 arranged concentrically with one another in the operating jaws 38, 39 to form a pivot axis 41 extending substantially perpendicular to the pivot plane 20. The driving clement 25 is further supported by a connecting bridge 43 of the operating jaws 38, 39 engaged behind it and by an end region 23 of the pivot arm 16 designed as a spreading jaw 44, via which the spreading forces will be transmitted to the driving element 25.

The connecting bridge 43 with the operating jaws 38, 39 are designed so as to form a fork head 45, this same design also being used on the other pivot arm 17 with the driving element 26.

Pressure rams 46, 47 of a pressure ram assembly 48 are mounted in radial bearings 40 of the driving elements 25, 26 by means of journals 49, 50. The pressure rams 46, 47 are made from tubular sections 51, for example, which are guided by means of a guiding system 52 concentrically with one another and so as to be axially stable relative to a longitudinal central axis 53 extending in the pivot plane 20 and are adjustable relative to one another via the pivot arms 16, 17 and their driving elements 25, 26 in the direction of the longitudinal central axis 53. In the embodiment illustrated as an example here, the guiding system 52 is designed as a telescopic assembly of sections 54 comprising tubular sections 55, 56, 57 sliding one inside the other.

Figure 4:
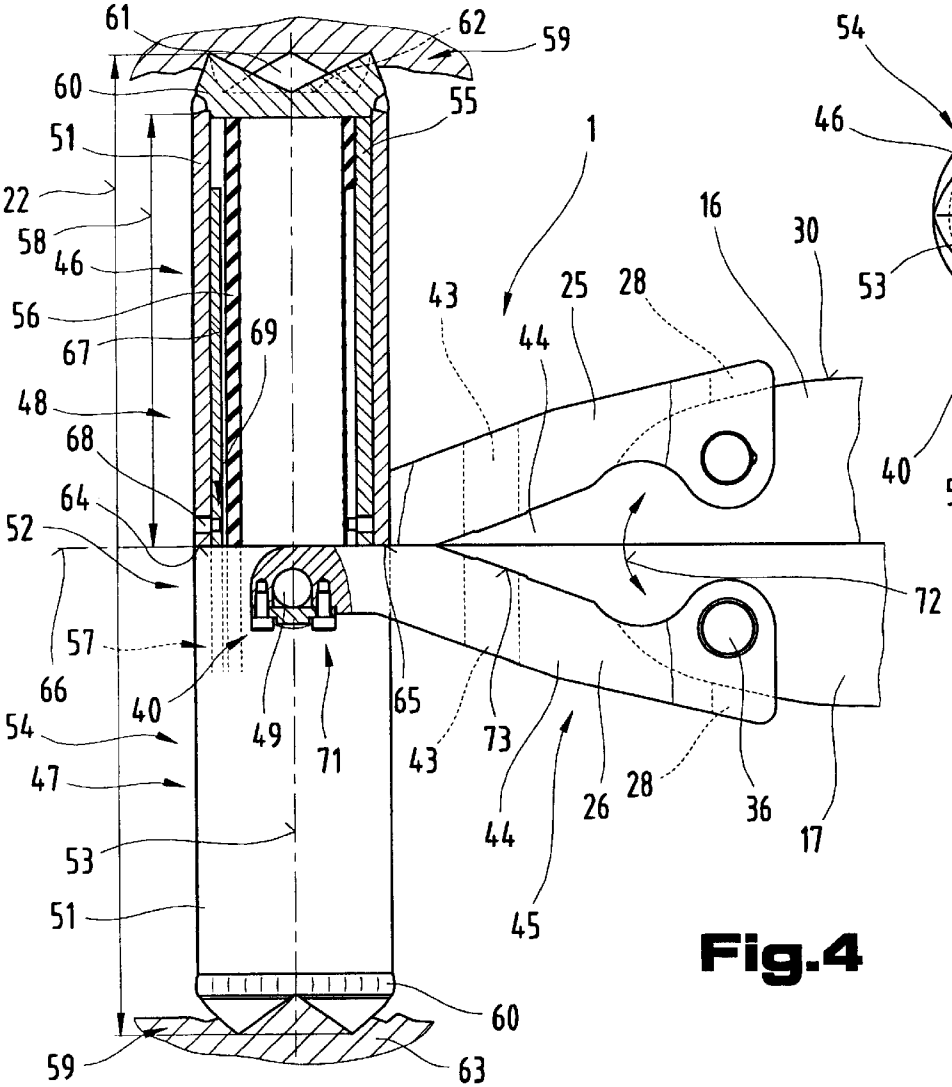
FIG. 4 is a front view of the spreading tool proposed by the invention in a retracted position, seen in partial section.

In FIG. 4, the spreading tool 1 is illustrated with the pressure ram assembly 48 in the retracted position. This being the case, the pivot arms 16, 17 with the driving elements 25, 26 are in their non-operating position. The pressure ram assembly 48 consists of the tubular sections 51 forming the pressure rams 46, 47. Each of the tubular sections 51 has a length 58 extending substantially in the direction of the longitudinal central axis 53 which corresponds to more or less half the minimum expandable width 22. At the opposing end regions 59, the tubular sections 51 are provided with closing end caps 60, which are welded on for example, provided with more or less pyramid-shaped projections 61 which stand proud of end faces 62. These projections 61 provide a non-slip contact with wall parts 63 to be spread, for example parts of bodywork, etc. When the spreading tool 1 is in this retracted state, end faces 64, 65 facing one another lie one on top of the other and the pivot arms 16, 17 and the fork heads 45 of the driving elements 25, 26 sit one on top of the other in a central plane 66.

Disposed inside the tubular sections 51 is the assembly of sections 54 consisting of tubular sections 55, 56, 57, forming the guiding system 52 for the pressure rams 46, 47. The assembly of sections 54 is coupled by means of grooves 67 and pins 68 with a stop system 69 regulating the slide path of the individual tubular sections 51, 55, 56, 57 relative to one another so that a coordinated motion of the tubular sections 51, 55, 56, 57 is produced when the pressure ram assembly 48 is extracted and retracted.

Extraction to a maximum expandable width 70—as illustrated in FIG. 1—is effected, as described in relation to the previous drawings, by swinging out the pivot arms 16, 17 with the driving elements 25, 26 and the drive connection comprising the journals 49, 50 and radial slide bearings 40 forming the pivot bearing 71.

When the pivot arms 16, 17 are displaced in a pivoting action in the direction of arrow 72, the driving elements 25, 26 supported by the spreading jaws 44 and by abutment surfaces 73 provided thereon, against which the connecting bridges 43 of the fork heads 45 bear, are also displaced, thereby displacing the pressure ram assembly 48 in the direction of the maximum expandable width 70. During the retraction movement, the pressure ram assembly 48 is driven via the driving elements 25, 26 by the base bridges 38 abutting against the rear faces 30, as a result of which the removable pins 36 afford the other point of support for applying the torques.

Figure 5:
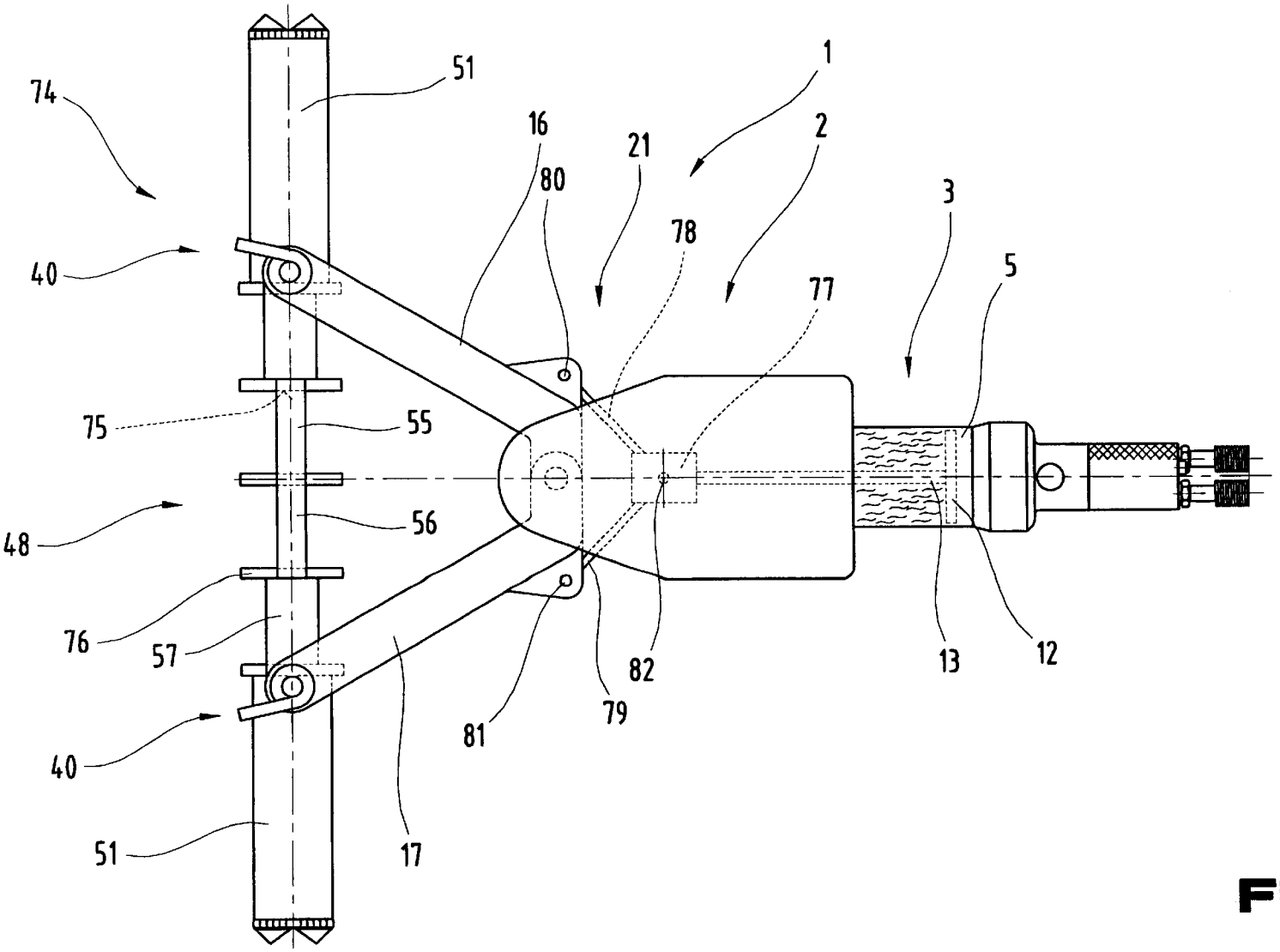
FIG. 5 illustrates a front view of another embodiment of the spreading tool proposed by the invention.

FIG. 5 illustrates another embodiment of a spreading tool 1 as proposed by the invention, having a fixing device 74 for the pressure ram assembly 48. This fixing device 74 enables the pressure ram assembly 48, in the extracted state for example, to be checked by means of bolts 76 insertable in bores 75 of the tubular sections 51, 55, 56, 57 thereby relieving the drive 3 of load, .e.g. pressure relief for the hydraulic system, or allows the rescue tool system 2 to be uncoupled altogether to afford better access conditions for an extrication for example, effectively preventing the spread wall parts 63 from springing back. To this end, the pivot bearings 71 may be of a design allowing them to be coupled—as illustrated in FIG. 4. As also illustrated in this embodiment, the pivot arms 16, 17 can be coupled directly to the pressure rams 46, 47 via the pivot bearings 71. FIG. 5 also illustrates how the force is transmitted from the drive 3, the piston rod 13 and a rod head 77 via linking levers 78, 79 forming the lever system 21, and bolts 80, 81, 82 to the pivot arms 16, 17.

Clearly, the fixing device 74 may also be provided in the form of threads on the tubular sections 55, 56, 57 and checking nuts engaging in the threads.

The pressure ram assembly 48 may consist of various types of telescopically arranged sections, such as circular tubes or hollow sections, having a square cross section for example, this arrangement also preventing twisting in addition to affording axial stability.

Finally, it should be pointed out that in order to provide a clearer understanding of the solution proposed by the invention, individual parts of the embodiments described as examples are illustrated out of scale.

List of reference numbers

| | | | |
|---|---|---|---|
| 1 | Spreading tool | 26 | Driving element |
| 2 | Rescue tool system | 27 | Linking region |
| 3 | Drive | 28 | Base bridge |
| 4 | Pressurised medium | 29 | Abutment |
| 5 | Cylinder | 30 | Rear face |
| 6 | Delivery line | 31 | Leg |
| 7 | Return line | 32 | Leg |
| 8 | Compressor unit | 33 | Side face |
| 9 | Hydraulic oil | 34 | Side face |
| 10 | Control unit | 35 | Bore |
| 11 | Multi-way valve | 36 | Removable pin |
| 12 | Piston | 37 | End region |
| 13 | Piston rod | 38 | Operating jaw |
| 14 | End face region | 39 | Operating jaw |
| 15 | Housing | 40 | Radial bearing |
| 16 | Pivot arm | 41 | Pivot axis |
| 17 | Pivot arm | 42 | |
| 18 | Mounting assembly | 43 | Connecting bridge |
| 19 | Pivot axis | 44 | Spreading claw |
| 20 | Pivot plane | 45 | Fork head |
| 21 | Lever system | 46 | Pressure ram |
| 22 | Expandable width | 47 | Pressure ram |
| 23 | End region | 48 | Pressure ram assembly |
| 24 | End region | 49 | Journal |
| 25 | Driving element | 50 | Journal |
| 51 | Tubular section | 76 | Bolt |
| 52 | Guiding system | 77 | Rod head |
| 53 | Longitudinal central axis | 78 | Linking lever |
| 54 | Assembly of sections | 79 | Linking lever |
| 55 | Tubular section | 80 | Bolt |
| 56 | Tubular section | 81 | Bolt |
| 57 | Tubular section | 82 | Bolt |
| 58 | Length | | |
| 59 | End region | | |
| 60 | End cap | | |
| 61 | Projection | | |
| 62 | End face | | |
| 63 | Wall part | | |
| 64 | End face | | |
| 65 | End face | | |
| 66 | Central plane | | |
| 67 | Groove | | |
| 68 | Pin | | |
| 69 | Stop system | | |
| 70 | Expandable width | | |
| 71 | Pivot bearing | | |
| 72 | Arrow | | |
| 73 | Abutment surface | | |
| 74 | Fixing device | | |
| 75 | Bore | | |

What is claimed is:

1. Spreading tool (1) for widening openings, in particular for use in extricating trapped persons, having a drive (3) to which a pressurized medium (4) is applied and, coupled therewith in order to effect a synchronous counter-pivoting motion in the form of cutting and/or spreading elements, pivotably mounted pivot arms (16, 17) in a housing accommodating the drive (3) and drivingly linked to a pressure ram assembly (48) which is displaceable in the direction of a parallel extending longitudinal central axis (53) substantially parallel with a pivot plane (20) of the pivot arms (16, 17), characterised in that finger-type driving elements (25, 26) are provided in projecting end regions (23, 24) of the pivot arms (16, 17) in order to operate the pressure ram assembly (48), having operating jaws (38, 39) facing two pressure rams (46, 47) and enclosing them in a U-shaped arrangement in a part region in the circumferential direction, being pivotably linked to the pressure rams (46, 47) via pivot bearings.

2. Spreading tool as claimed in claim 1, characterised in that the pressure ram assembly (48) having said two pressure rams (46, 47) spaced apart from one another in the direction of the longitudinal central axis (53), which are guided in displacement relative to one another in an axially stable guiding system (52) extending in the direction of the longitudinal central axis (53).

3. Spreading tool as claimed in claim 2, characterised in that the guiding system (52) is provided in the form of a telescopically displaceable assembly of sections (54).

4. Spreading tool as claimed in claim 1, characterised in that the pressure rams (46, 47) are provided in the form of tubular sections (51) provided with end caps (60) in the opposing end regions (59), which engagingly link with the telescopic assembly of sections (54).

5. Spreading tool as claimed in claim 1, characterised in that the assembly of sections (54) linking the pressure rams (46, 47) is provided in the form of tubular sections (55, 56, 57) guided one inside the other.

6. Spreading tool as claimed in claim 2, characterised in that the tubular sections (55, 56, 57) of the assembly of sections (54) are provided with a stop system (69) to restrict the displacement path.

7. Spreading tool as claimed in claim 1, characterised in that the driving elements (25, 26) are removably linked to the pivot arms (16, 17) by removable pins (36) inserted through bores (35) of the driving elements (25, 26) and the pivot arms (16, 17).

8. Spreading tool as claimed in claim 1, characterised in that pivot bearings, preferably radial bearings (40) are provided on the operating jaws (38, 39).

9. Spreading tool as claimed in claim 1, characterised in that concentrically extending journals (49, 50) integral with the pressure rams (46, 47) in displacement are pivotably mounted in the radial bearings (40) projecting beyond the pressure rams (46, 47) in a radial direction.

10. Spreading tool as claimed in claim 8, characterised in that the telescopic pressure ram assembly (48) is provided in the form of tubular sections.

11. Spreading tool as claimed in claim 1, characterised in that the telescopic pressure ram assembly (48) is provided in the form of hollow profiled sections with a substantially square cross section.

12. Spreading tool as claimed in claim 2, characterised in that the guiding system (52) is provided with a fixing device (74) to check displacement of the pressure ram assembly (48).

13. Spreading tool as claimed in claim 12, characterised in that the fixing device (74) comprises bolts (76) inserted in bores (75) extending in a radial direction through the tubular sections (51, 55, 56, 57) of the assembly of sections (54).

14. Spreading tool as claimed in claim 12, characterised in that the fixing device (74) is provided in the form of threads and checking nuts on the tubular sections (51, 55, 56, 57) of the assembly of sections (54).

15. Spreading tool as claimed in claim 1, characterised in that a distance between opposing end faces (62) of the pressure rams (46, 47) can be adjusted from a minimum expandable width of approximately 250 mm to 300 mm up to a preferred maximum expandable width (70) of approximately 700 mm.

16. Spreading tool as claimed in claim 4, characterised in that the end caps (60) of the pressure rams (46, 47) are provided with projections (61) standing proud of the end faces (62).

* * * * *